United States Patent [19]

Morrison et al.

[11] Patent Number: 4,713,931

[45] Date of Patent: Dec. 22, 1987

[54] APPARATUS FOR VACUUM SPINNING

[75] Inventors: Elbert F. Morrison, Clarksville, Va.; Danny R. Bradley, Bullock; D. C. Reece, Oxford, both of N.C.

[73] Assignee: Burlington Industries, Inc., Greensboro, N.C.

[21] Appl. No.: 677,487

[22] Filed: Dec. 3, 1984

Related U.S. Application Data

[63] Continuation-in-part of Ser. No. 386,078, Jun. 7, 1982, Pat. No. 4,507,913.

[51] Int. Cl.[4] ..... D01H 5/28; D01H 1/12; D02G 1/06

[52] U.S. Cl. ..... 57/328; 57/5; 57/224; 57/331; 57/333; 57/334; 57/341; 57/400

[58] Field of Search ..... 57/5, 6, 204, 210, 224, 57/328, 334, 333, 341–344, 400–403, 409, 331

[56] References Cited

U.S. PATENT DOCUMENTS

| | | | |
|---|---|---|---|
| 3,079,746 | 3/1963 | Field, Jr. | 57/328 |
| 3,757,507 | 9/1973 | Maxham | 57/409 X |
| 3,802,174 | 4/1974 | Landwehrkamp et al. | 57/5 |
| 3,978,648 | 9/1976 | Yamagata et al. | 57/5 X |
| 4,183,202 | 1/1980 | Morihashi | 57/328 |
| 4,265,082 | 5/1981 | Sasaki et al. | 57/328 X |
| 4,322,944 | 4/1982 | Sraitr et al. | 57/328 |
| 4,507,913 | 4/1985 | Morrison | 57/328 |
| 4,509,321 | 4/1985 | Kajita et al. | 57/328 |

FOREIGN PATENT DOCUMENTS 143050 10/1971 Czechoslovakia .

880239 10/1961 United Kingdom .

*Primary Examiner*—John Petrakes

*Attorney, Agent, or Firm*—Nixon & Vanderhye

[57] ABSTRACT

Vacuum spun yarn is produced that has strength property approaching that of ring spun yarn, and significantly greater than air jet spun yarn, and may be produced at speeds greatly in excess of production speeds for ring spun yarn. An elongated hollow shaft has a through-extending passageway from a first end to a second end thereof, with a portion of the shaft adjacent the first end being perforated (e.g. four equally spaced perforations). The perforations shaft in the direction of the second end from the through-extending passageway, and a generally spherical vacuum reservoir is formed in the shaft in communication with the passageway and perforations. The portion of the passageway between the shaft first end and the vacuum reservoir is significantly larger in cross-sectional dimension than the portion of the passageway from the vacuum reservoir to the second end of the shaft. A diffuser, in the form of a collar having elongated slots corresponding to the perforations, surrounds the shaft, and an annular opening is provided between the interior of the diffuser collar and the exterior of the shaft. The shaft is rotated about an axis at a constant high speed, and a vacuum is applied to the exterior of the shaft so that at least some of the fibers or free ends of fibers passing through the shaft will draw toward the shaft perforations, and will be caused to rotate with the shaft as fibers move generally linearly along the axis of rotation of the shaft. Formed yarn, having the desired properties, is withdrawn from the second end of the shaft.

38 Claims, 3 Drawing Figures

APPARATUS FOR VACUUM SPINNING

CROSS-REFERENCE TO RELATED APPLICATION

This application is a continuation-in-part of application Ser. No. 386,078 filed June 7, 1982, now U.S. Pat. No. 4,507,913.

BACKGROUND AND SUMMARY OF THE INVENTION

In U.S. Pat. No. 4,507,913, a desirable apparatus for vacuum spinning of yarn has been disclosed. The apparatus of that patent is very useful for the production of yarn in an efficient manner, however the yarn produced thereby does not have as much versatility—use in a large variety of different fabrics having different purposes—as desired.

According to the present invention, an apparatus is provided which is an improvement over the apparatus in said U.S. Pat. No. 4,507,913. The apparatus according to the present invention allows the production of yarn having a number of better properties than the yarn usually produced by the apparatus of said U.S. Pat. No. 4,507,913, including enhanced uniformity.

The apparatus according to the invention, like that in said co-pending application, includes an elongated hollow shaft having first and second ends, with a through-extending passageway, and at least a portion of the entire circumference of the shaft is perforated. Means are provided for mounting the shaft for rotation about an axis, and means are provided for rotating the shaft about its axis. Also means are provided for passing textile fibers through the through-extending passageway of the shaft linearly, generally along the axis of rotation, the fibers being fed into the first end of the shaft. Means are also provided for applying a vacuum to the exterior of the shaft so that at least some of the fibers or free ends of fibers passing through the shaft will draw toward the shaft perforations, and will be caused to rotate with the shaft as the fibers move linearly generally along the axis of rotation. Also means are provided for withdrawing formed yarn from the second end of the shaft, opposite the first end.

One of the major distinctions of the apparatus of the invention compared to that in said U.S. Pat. No. 4,507,913 is the construction and positioning of the perforations of the shaft. According to the invention, perforations are provided that slant in the direction of the second end from the through-extending passageway. The slanting perforations provide a more even flow of air from the exterior of the shaft to the vacuum source, with desirable results on the yarn production. It has also been found that only perforations adjacent the first end of the shaft are necessary, additional perforations further on down the shaft not performing any significant function, and that only four perforations—preferably equally spaced around the periphery of the shaft in a plane perpendicular to the axis of rotation of the shaft —are all that are necessary.

Another significant feature of the apparatus according to the present invention, vis-a-vis that of said U.S. Pat. No. 4,507,913, is the provision of a vacuum reservoir within the shaft itself in communication with the perforations. The vacuum reservoir preferably is a spherical opening within the shaft, with a common plane containing the four perforations generally at the center of the sphere. The vacuum reservoir provides for better wrapping action of fiber ends, resulting in the production of a stronger yarn.

Yet another significant distinction of the apparatus according to the invention, vis-a-vis that shown in said co-pending application, is the provision of a diffuser surrounding the shaft. The diffuser primarily assists in providing a more even wrap of the fibers, this again contributing to yarn strength. Also the diffuser assists in preventing the fibers from going out the perforations at start-up, or during other operating conditions, and it is desirable to have the diffuser mounted so that elongated slots therein can either be aligned with the perforations in the shaft (the normal desired configuration for optimum wrapping action), or the diffuser slots can be misaligned, which can result in "effects" in the yarn being produced.

The through-extending passageway in the shaft preferably has a larger diameter at the first end of the shaft than at the second end of the shaft. The diameter at the first end of the shaft, up to the vacuum reservoir, typically could be twice that in that portion of the shaft from the vacuum reservoir to the second end thereof. This distinction of the apparatus according to the invention compared to that in said U.S. Pat. No. 4,507,913 causes the air flow to concentrate adjacent the entry end of the shaft, and results in more desirable wrapping and therefore an improved yarn.

While the shaft of the apparatus according to the present invention may be rotated by action of the air flow upon vanes, as in said U.S. Pat. No. 4,507,913, it is more desirable to provide for the rotation to be effected by a conventional positive drive system utilizing pulleys and a belt. A motor rotates one pulley, which through the belt causes a pulley attached to the shaft to rotate. This results in a more controllable, much more uniform speed than can be achieved when most vacuum sources are utilized, since the average vacuum source tends to pulsate to a certain extent.

Utilizing the apparatus according to the present invention, it is possible to produce a yarn much faster than by ring spinning (for instance on the order of approximately 150 yards per minute), with a strength between that of ring spun yarn and yarn spun by air jets (such as Murata air jets). Yarn can be produced utilizing 100 percent wool, polyester/wool combinations, all cotton, and cotton/polyester combinations. Also, a number of different types and effects of yarn can readily be produced, as disclosed in co-pending application Ser. No. 680,510 filed Dec. 11, 1984, of Elbert F. Morrison for "Spinning With Vacuum". Further, according to the invention the yarn can be produced with selected properties, which properties need not be optimum properties, but can vary greatly.

It is the primary object of the present invention to provide an apparatus capable of producing good quality yarn at relatively high speed, and to produce such yarn. This and other objects of the invention will become clear from an inspection of the detailed description of the invention, and from the appended claims.

DETAILED DESCRIPTION OF THE DRAWINGS

Figure 1:
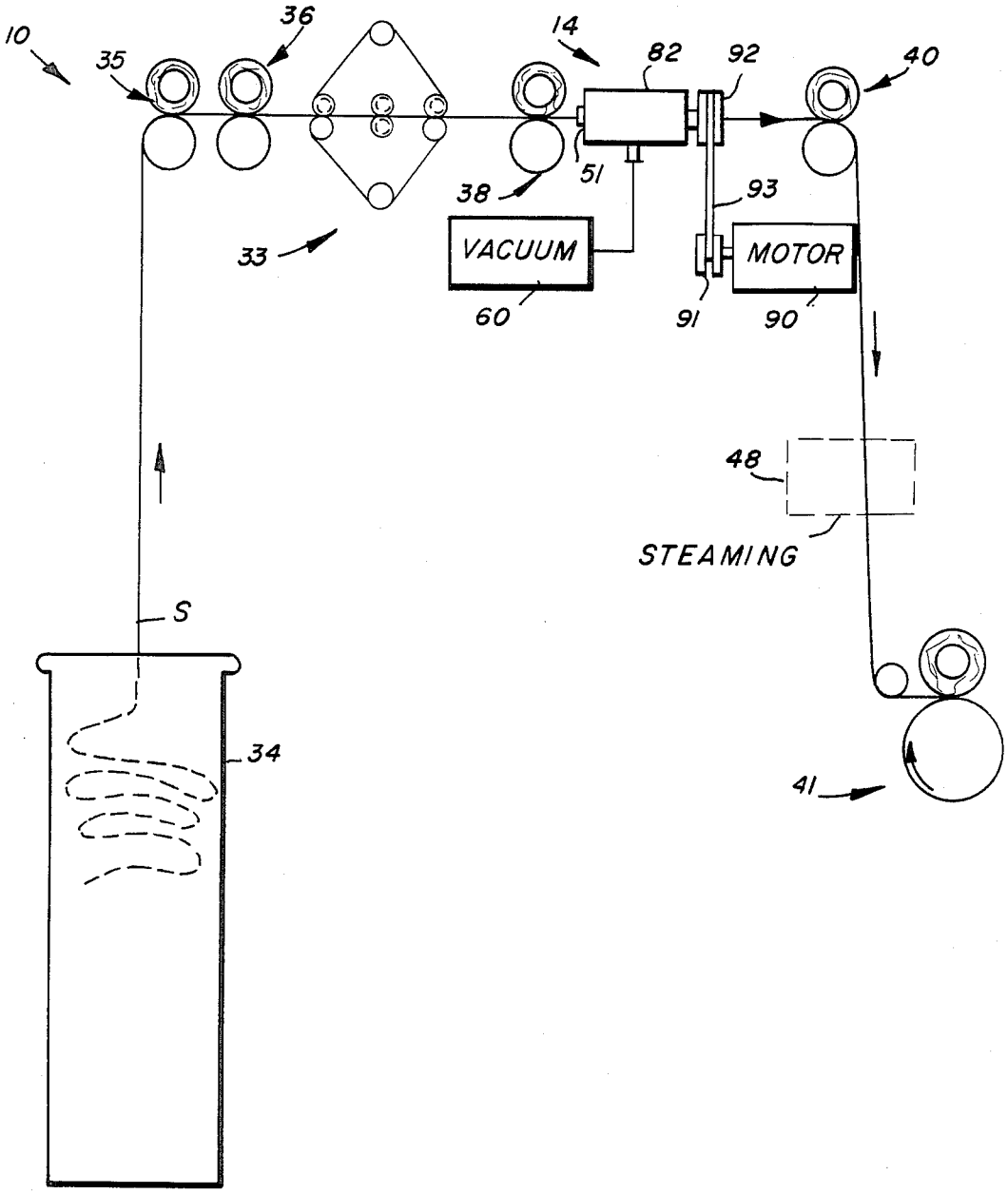
FIG. 1 is a side schematic view of an exemplary system utilizing an exemplary vacuum spinning apparatus according to the present invention.

The system illustrated in FIG. 1 is essentially the same as that illustrated in FIG. 1 of said U.S. Pat. No. 4,507,913 except for the construction of the vacuum spinning apparatus 14. That is the system 10 comprises a draft system, generally indicated by reference numeral 33, to which sliver or roving S is fed from a bin 34, drawn by the feed roll sets 35, 36. After drafting, the sliver passes through the nip of the front feed roll set 38, and after exiting the apparatus 14 the produced yarn Y passes through the nip of the delivery rolls 40. The yarn is eventually taken up by conventional take-up roller means 41, and may be passed through a steaming station 48, or like treatment station.

Figure 2:
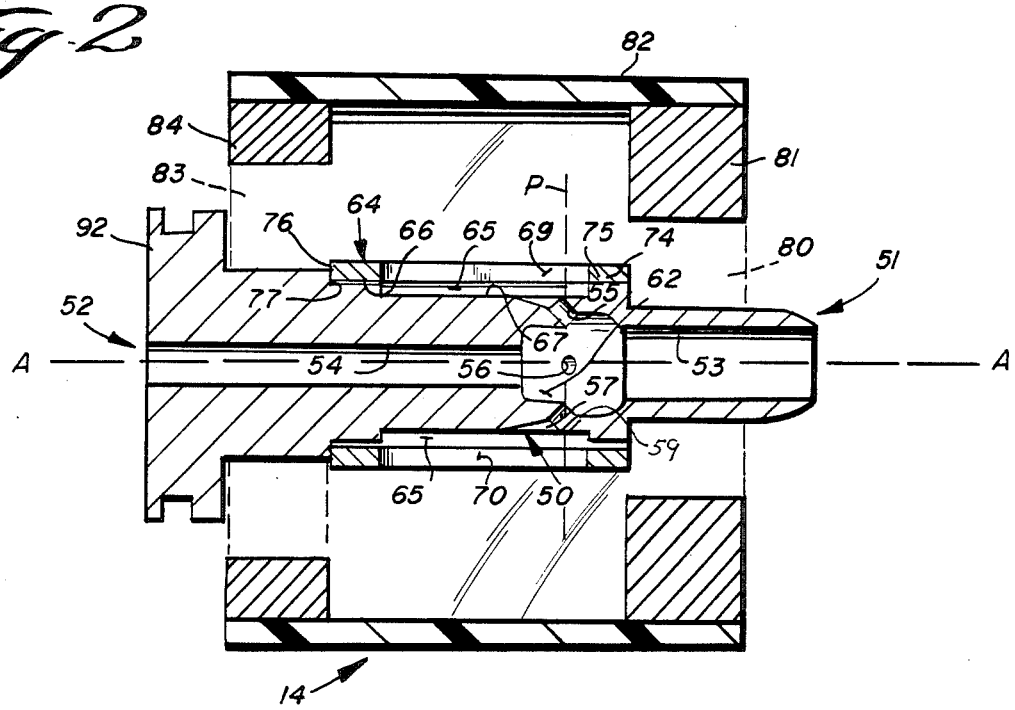
FIG. 2 is a side cross-sectional view of the exemplary vacuum apparatus of FIG. 1.
Figure 3:
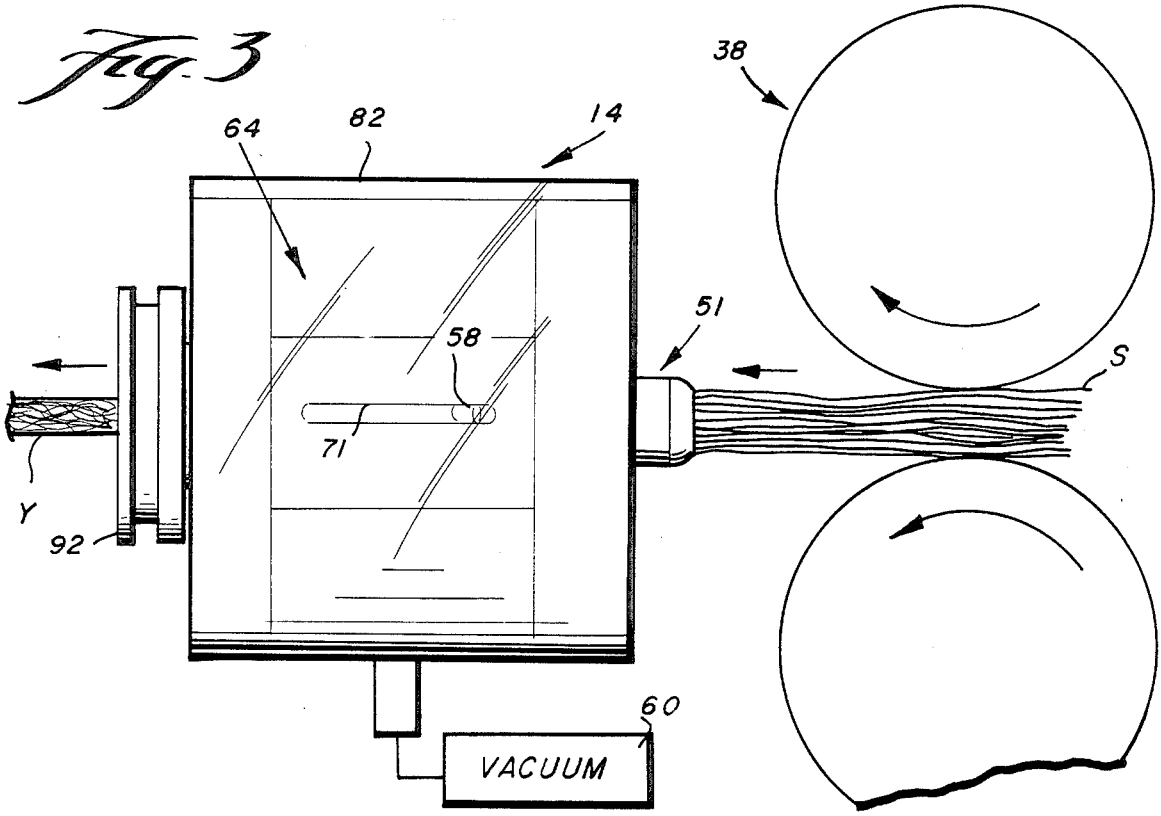
FIG. 3 is a side view of the apparatus of FIG. 2, shown in schematic cooperation with the vacuum source and feed rollers.

The vacuum spinning apparatus 14 is illustrated more clearly in FIGS. 2 and 3. The primary component thereof comprises an elongated hollow shaft 50 having a first end 51 and a second end 52. A through-extending passageway, having a first section 53 and a second section 54, is provided in the shaft 50, extending from the first end 51 to the second end 52 thereof. At least a portion of the entire circumference of the shaft 50 is perforated. Preferably the perforations are provided by four perforations equally spaced around the circumference of the exterior of the shaft 50, and indicated by reference numerals 55–58 in FIGS. 2 and 3. Perforations preferably are in a common plane P which is perpendicular to the axis A—A of rotation of the shaft 50. Also, the perforations 55–58 preferably slant in the direction of the second end from the through-extending passageway portion 53 (see perforations 55, 57 in FIG. 2 in particular). This disposition of the perforations 55–58 at an acute angle with respect to the axis A—A allows air that is sucked into the passageway portion 53 by the vacuum source 60 (see FIGS. 1 and 3) to flow more uniformly from exteriorly of the shaft 50 to the source 60, with commensurate desirable results for the yarn being produced.

While perforations 55–58 may be disposed at other locations along the length of the shaft 50, and need not be four in number (i.e. there may be more, but preferably not less than three), the desired results can be achieved by disposing the perforations 55–58 only adjacent the first end 51 of the shaft 50, as illustrated in FIG. 2.

According to the present invention, it is also desirable to provide a vacuum reservoir 62 (see FIG. 2) within the shaft 50. The vacuum reservoir 62 as illustrated in the drawings comprises a spherical reservoir having a diameter roughly about twice the diameter of the passageway portion 53, and in communication with the passageway portions 53, 54 at the opposite ends thereof, and in communication with the perforations 55–58 around the periphery thereof at an intermediate, tapered portion 59 which extends radially inwardly from the first end toward the second end. The reservoir need not be spherical, although that is a desirable configuration. Alternatively, the reservoir could be cylindrical with spherical sections at the ends thereof, or of like configuration. The vacuum reservoir provides for better air flow within the shaft 50, ultimately resulting in better wrapping of the fiber ends, and the production of a higher quality yarn Y.

The vacuum reservoir also provides a volume for radial deflection of the fibers so that the wrapping function is facilitated.

In the utilization of the apparatus 14, it is desirable to concentrate the air flow adjacent the first end 51 of the shaft 50. To this end, it is desirable to make the passageway section 53 of significantly larger size than the passageway 54. The passageway 53 extends from the end 51 to the vacuum reservoir 62, while the section 54 extends from the vacuum resevoir 62 to the second end 52. As exemplary, but nonlimiting, examples of dimensions, the diameter of the section 53 may be $\frac{1}{8}$ inch, the diameter of the section 54 1/16 inch, and the diameter of the spherical vacuum reservoir 62 about one-quarter inch.

In order to even further facilitate the wrapping action, it is desirable to provide a diffuser 64. The diffuser 64 comprises a sleeve or collar which fits around the external periphery of the shaft 50. As seen in FIG. 2, preferably a ring-shaped space 65 is provided between the internal surface 66 of the collar 64, and the external periphery 67 of the shaft 50. The collar 64 includes a plurality of elongated slots formed therein, elongated in the dimension of the axis A—A. Preferably a slot is provided in association and communication with each of the perforations 55–58; for instance see slots 69 and 70 in FIG. 2 which cooperate with perforations 55 and 57, respectively, and slot 71 in FIG. 3 which cooperates with perforation 58. The slots (e.g. 69–71) and the space 65 assist in providing desired air flow characteristics to improve the quality of the yarn Y produced utilizing the apparatus 14.

The collar 64 is preferably mounted on the shaft 50 so that the alignment of the slots (e.g. 69–71) with respect to the perforations 55–58 can be changed. For instance the collar 64 is mounted so that a first end surface 74 thereof engages a raised surface 75 of the shaft 50, and so that a second end surface 76 thereof engages another raised surface 77 of the shaft 50. There is frictional engagement between the surfaces 74, 75 and 76, 77, however the frictional engagement is not too great to prevent relative rotation between the collar 64 and the shaft 50 if the collar 64 is grasped manually, or with a tool, and rotation effected. By misaligning the slots (e.g. 69–71) and the perforations 55–58, "effects" may be introduced into the yarn Y.

The roller sets 38, 40, comprise means for passing textile fibers into and through the passage sections 53, 54, and preferably the nips of the rollers 38, 40 are aligned with each other and with the axis A—A. Means are also provided for mounting the shaft 50 for rotation about the axis A—A, and for effecting continuous, relatively high-speed rotation thereof.

The means for mounting the shaft 50 for rotation preferably comprise bearing means adjacent the first and second ends 51, 52 thereof. For instance a first bearing means 80 surrounds the first end 51 of the shaft 50, providing relative rotation between it and a front wall 81 of an air impervious cylindrical housing 82, and a second bearing 83 is mounted adjacent the second end 52 of the shaft 50, allowing relative rotation between the shaft 50 and the rear wall 84 of the housing 82. Preferably the housing 82 is transparent, as seen in FIG. 3. The bearings 80, 83 may be of any conventional type that do not allow passage of significant amounts of air therethrough, and/or are not dried out, or otherwise damaged, by air flow therethrough. The housing 82 is stationarily mounted on a table, or other structure which is affixed to the ground.

Rotation of the shaft 50 is effected by the motor 90 (see FIG. 1) acting upon the shaft 50 via pulleys 91, 92 and belt 93. Pulley 92 preferably is integral with the shaft 50, and pulley 91 is integral with the motor output shaft. The motor 90 thus rotates the shaft 50 at a constant desired speed, which speed may be varied by varying the speed of the motor.

The materials of which the components of the apparatus 14 are constructed are not particularly critical. Preferably the shaft 50 and diffuser 64 will be of metal (such as steel) or ceramic, however other materials may also be utilizable. The housing 82 preferably is of a transparent plastic, although again a wide variety of materials may be utilized. The vacuum source 60 may be any conventional desired vacuum source, such as a vacuum pump which provides 20 inches of mercury at 19 cfm (or more).

If desired, a core filament, or looped filaments, can be added in with the sliver S, and like other variations can be made, such as described in said co-pending application Ser. No. 680,510.

By the practice of the present invention, a yarn can be produced at high speed, that has strength and other properties intermediate those of air jet spun yarn and ring spun yarn, and in fact closely approaching those of ring spun yarn. It has also been found that when fabric is produced from 55% polyester, 45% wool, yarn according to the invention, the fabric has very uniform dyeability.

In exemplary production of yarn utilizing the apparatus of FIGS. 1 through 3, a roving containing 55% polyester (Dacron) and 45% wool was the feed material (S), and the shaft 50 was rotated at a constant speed of 3550 rpm, and the vacuum source 60 provided 20 inches of mercury. The yarn that was produced was tested and was found to have a B-work (in gf centimeter) of 2167 with a coefficient of variation of 25.34% (hereinafter "CV%"), a B-force (in gf) of 390.1 with a CV% of 11.80, a tenacity (in gf/tex) of 8.67 with a CV% of 11.80, and an elongation (in percent) of 17.72, with a CV% of 14.28.

In another exemplary production of yarn utilizing the apparatus of FIGS. 1 through 3, a roving containing 50 percent polyester and 50 percent cotton was the feed material (S), and the shaft 50 was rotated at a constant speed of 3550 RPM, and the vacuum source 60 provided 20 inches of mercury. The yarn that was produced was tested and was found to have a B-work (in gf centimeter) 3493, with a coefficient of variation of 20.42 percent (hereinafter "CV%"), a B-force (in gf) of 615.1 with a CV% of 10.01, a tenacity (in gf/tex) of 9.61 with a CV% of 10.01, and an elongation (in percent) of 17.53, with a CV% of 11.44.

Table I compares properties of yarn produced utilizing the vacuum spinning apparatus 14 according to the present invention compared to short staple ring spun natural yarn, short staple open-end spun - stretch break-rebreak dyed yarn, regular worsted long staple ring spun natural yarn, and short staple carded open-end spun natural yarn. These results indicate that yarn according to the invention has strength properties approaching that of ring spun yarn, and significantly greater than that of air jet spun yarn (open-end spun). Yarn can be produced according to the invention, however, at speeds several times greater than for ring spun yarn. Typically ring spun yarn can be produced at 20 yards per minute, and yarn can be produced by air jets at about 160 meters per minute. Yarn according to the invention can be produced at speeds approaching 150 yards per minute (although the yarns according to the invention set forth in Table I were produced at about 25 yards per minute).

TABLE I

| TYPE TEST | Yarn A | Yarn B | Yarn C | Yarn D | Yarn E | Yarn F |
|---|---|---|---|---|---|---|
| Evenness % CV | 17.10 | 16.05 | 16.55 | 16.94 | 13.07 | 16.42 |
| Thin Places/1 M Yds. | 96.5 | 54.0 | 74.0 | 75.0 | 1.0 | 47.8 |
| Thick Places/1 M Yds. | 171.5 | 77.0 | 36.0 | 15.0 | 0.0 | 18.8 |
| Neps/1 M Yds. | 16.8 | 5.5 | 35.0 | 11.0 | 7.0 | 18.3 |
| Gram Break | 523.3 | 443.4 | 521.6 | 567.0 | 661.2 | 394.8 |
| % CV of Break | 11.6 | 9.8 | 13.3 | 11.6 | 11.0 | 9.6 |
| % Under 125 Gms. | 0.0 | 0.0 | 0.0 | 0.0 | 0.0 | 0.0 |
| % Elongation | 17.0 | 14.3 | 16.1 | 17.5 | 24.4 | 18.8 |
| % CV of Elongation | 12.2 | 8.6 | — | — | — | — |
| % Under 10% | 2.0 | 0.0 | 1.0 | 0.0 | 0.0 | 0.0 |
| Worsted Count | 1/18.1 | 1/18.2 | 1/18.39 | 1/17.92 | 1/18.05 | 1/17.89 |
| Single Twist | 15.2 Z | 15.4 Z | VS | VS | 15.5 Z | 16.3 Z |
| Boil-Off Shrinkage (%) | 2.06 | 5.85 | 3.37 | 1.96 | 2.50 | 1.57 |
| Dry-Heat Shrinkage (%) | 2.17 | 4.98 | 2.39 | 2.39 | 1.85 | 2.00 |
| Blend | | | | | | |
| % Poly | 55.94 | 56.34 | 55.52 | 55.17 | 54.43 | 54.98 |
| % Wool | 44.06 | 43.66 | 45.48 | 44.83 | 45.57 | 45.02 |
| Kink Level/18" | 37.0 | 36.0 | 8.7 | 11.3 | 40.0 | 33.3 |
| % Oil Content | 1.22 | 0.96 | 0.52 | 0.73 | 0.55 | .86 |

KEY:
YARN A - Short Staple Ring Spun Natural
YARN B - Short Staple Open-End Spun - Stretch Break-Rebreak Dyed
YARN C - Vacuum Spun from Roving Natural, According to Invention
YARN D - Vacuum Spun from Sliver Natural, According to Invention
YARN E - Regular Worsted Ring Spun Natural
YARN F - Short Staple Carded Open-End Spun Natural
NOTE:
Yarns C, D, And E are long staple yarns (i.e., staple length 3½" plus).

It will thus be seen that according to the present invention apparatus has been provided for the effective and efficient production of spun yarn having good strength properties. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and products.

What is claimed is:

1. Apparatus for forming yarn comprising: an elongated hollow shaft having a first end and a second end, a through-extending passageway from the first end to the second end, at least a portion of the entire circumference of the shaft being perforated; means for mounting said shaft for rotation about an axis; means for rotating said shaft about its axis; means for passing textile fibers through the through-extending passageway of said shaft linearly, generally along the axis of rotation thereof, the fibers being fed into the first end thereof; means for applying a vacuum to the exterior of said shaft so that at least some of the fibers or free ends of fibers passing through said shaft will draw toward the shaft perforations, and will be caused to rotate with said shaft as the remaining fibers are maintained generally parallel an move generally linearly along the axis of rotation; means for withdrawing formed yarn from the second end of said shaft, opposite said first end thereof; and wherein the perforations in said portion of said hollow shaft comprise perforations that slant in the direction of said second end from the through-extending passageway.

2. Apparatus for forming yarn comprising: an elongated hollow shaft having a first end and a second end, a through-extending passageway from the first end to the second end, at least a portion of the entire circumference of the shaft being perforated; means for mounting said shaft for rotation about an axis; means for rotating said shaft about its axis; means for passing textile fibers through the through-extending passageway of said shaft linearly, generally along the axis of rotation thereof, the fibers being fed into the first end thereof; means for applying a vacuum to the exterior of said shaft so that at least some of the fibers or free ends of fibers passing through said shaft will draw toward the shaft perforations, and will be caused to rotate with said shaft as said fibers move linearly generally along the axis of rotation; means for withdrawing formed yarn from the second end of said shaft, opposite said first end thereof;

wherein the perforations in said portion of said hollow shaft comprise perforations that slant in the direction of said second end from the through-extending passageway and further comprising means defining a vacuum reservoir in said shaft adjacent said first end thereof, and from which said perforations extend.

3. Apparatus as recited in claim 2 wherein the diameter of said through-extending passageway of said hollow shaft adjacent said first end thereof, from the first end thereof to said vacuum reservoir, is X; and wherein the diameter of said through-extending passageway of said hollow shaft from said vacuum reservoir to said second end of said shaft is x; and wherein X is significantly greater than x.

4. Apparatus as recited in claim 3 wherein said perforations consist of four perforations formed in said shaft adjacent said first end thereof, and disposed in substantially a common plane perpendicular to the axis of rotation of said shaft.

5. Apparatus as recited in claim 4 further comprising a diffuser surrounding said shaft and rotatable therewith.

6. Apparatus as recited in claim 5 wherein said diffuser comprises a collar having an elongated slot formed therein corresponding to, and in communication with, each of said perforations; and wherein said collar has an interior surface that is spaced from the exterior surface of said shaft at the area thereof adjacent said perforations and said slots.

7. Apparatus as recited in claim 3 wherein said vacuum reservoir comprises a generally spherical reservoir having a diameter of approximately 2X.

8. Apparatus as recited in claim 2 wherein said perforations are formed only at an area of said shaft adjacent said first end thereof, the rest of the length of said shaft being free of perforations.

9. Apparatus as recited in claim 8 wherein said through-extending passageway of said shaft from said first end thereof to approximately the area of said perforations has a diameter X, and wherein said through-extending passageway from approximately the area of said perforations to the second end of said shaft has a diameter x; and wherein X is significantly greater than x.

10. Apparatus as recited in claim 8 wherein said perforations consist of four perforations formed in said shaft adjacent said first end thereof, and disposed in substantially a common plane perpendicular to the axis of rotation of said shaft.

11. Apparatus as recited in claim 1 further comprising a diffuser surrounding said shaft and rotatable therewith.

12. Apparatus as recited in claim 11 wherein said perforations consist of four perforations formed in said shaft adjacent said first end thereof, and disposed in substantially a common plane perpendicular to the axis of rotation of said shaft.

13. Apparatus for forming yarn comprising: an elongated hollow shaft having a first end and a second end, a through-extending passageway from the first end to the second end, at least a portion of the entire circumference of the shaft being perforated; means for mounting said shaft for rotation about an axis; means for rotating said shaft about its axis; means for passing textile fibers through the through-extending passageway of said shaft linearly, generally along the axis of rotation thereof, the fibers being fed into the first end thereof; means for applying a vacuum to the exterior of said shaft so that at least some of the fibers or free ends of fibers passing through said shaft will draw toward the shaft perforations, and will be caused to rotate with said shaft as said fibers move linearly generally along the axis of rotation; means for withdrawing formed yarn from the second end of said shaft, opposite said first end thereof;

wherein the perforations in said portion of said hollow shaft comprise perforations that slant in the direction of said second end from the through-extending passageway and further comprising a diffuser surrounding said shaft and rotatable therewith, wherein said diffuser comprises a collar having an elongated slot formed therein corresponding to, and in communication with, each of said perforations; and wherein said collar has an interior surface that is spaced from the exterior surface of said shaft at the area thereof adjacent said perforations and said slots.

14. Apparatus for forming yarn comprising: an elongated hollow shaft having a first end and a second end, a through-extending passageway from the first end to the second end, at least a portion of the entire circumference of the shaft being perforated; means for mounting said shaft for rotation about an axis; means for rotating said shaft about its axis; means for passing textile fibers through the through-extending passageway of said shaft linearly, generally along the axis of rotation thereof, the fibers being fed into the first end thereof; means for applying a vacuum to the exterior of said shaft so that at least some of the fibers or free ends of fibers passing through said shaft will draw toward the shaft perforations, and will be caused to rotate with said shaft as said fibers move linearly generally along the axis of rotation; means for withdrawing formed yarn from the second end of said shaft, opposite said first end thereof;

wherein the perforations in said portion of said hollow shaft comprise perforations that slant in the direction of said second end from the through-extending passageway and further comprising a diffuser surrounding said shaft and rotatable therewith, wherein said perforations consist of four perforations formed in said shaft adjacent said first end thereof, and disposed in substantially a common plane perpendicular to the axis of rotation of said shaft and wherein said diffuser comprises a collar having an elongated slot formed therein corresponding to, and in communication with, each of said perforations; and wherein said collar has an interior surface that is spaced from the exterior surface of said shaft at the area thereof adjacent said perforations and said slots.

15. Apparatus as recited in claim 13 wherein said means for mounting said shaft for rotation comprises bearing means mounted to said shaft at two spaced portions thereof at opposite ends of said collar.

16. Apparatus for forming yarn comprising: an elongated hollow shaft having a first end and a second end, a through-extending passageway from the first end to the second end, at least a portion of the entire circumference of the shaft being perforated; means for mounting said shaft for rotation about an axis; means for rotating said shaft about its axis at a constant speed; means for passing textile fibers through the through-extending passageway of said shaft linearly, generally along the axis of rotation thereof, the fibers being fed into the first end thereof; means for applying a vacuum to the exterior of said shaft so that at least some of the fibers or free ends of fibers passing through said shaft will draw toward the shaft perforations, and will be caused to rotate with said shaft as said fibers move linearly generally along the axis of rotation; means for withdrawing formed yarn from the second end of said shaft, opposite said first end thereof; and means defining a vacuum reservoir in said shaft adjacent said first end thereof, and from which said perforations extend.

17. Apparatus as recited in claim 16 wherein said through-extending passageway of said shaft from said first end thereof to approximately the area of said perforations has a diameter X, and wherein said through-extending passageway from approximately the area of said perforations to the second end of said shaft has a diameter x; and wherein X is significantly greater than x.

18. Apparatus as recited in claim 17 wherein said vacuum reservoir comprises a generally spherical reservoir having a diameter of aproximately 2X.

19. Apparatus as recited in claim 16 further comprising a diffuser surrounding said shaft and rotatable therewith.

20. Apparatus as recited in claim 19 wherein said diffuser comprises a collar having an elongated slot formed therein corresponding to, and in communication with, each of said perforations; and wherein said collar has an interior surface that is spaced from the exterior surface of said shaft at the area thereof adjacent said perforations and said slots.

21. Apparatus as recited in claim 16 wherein said vacuum reservoir comprises a spherical reservoir having a diameter significantly greater than the diameter of said through-extending passageway.

22. Apparatus as recited in claim 16 wherein said perforations consist of four perforations formed in said shaft adjacent said first end thereof, and disposed in substantially a common plane perpendicular to the axis of rotation of said shaft.

23. Apparatus for forming yarn comprising: an elongated hollow shaft having a first end and a second end, a through-extending passageway from the first end to the second end, at least a portion of the entire circumference of the shaft being perforated; means for mounting said shaft for rotation about an axis; means for rotating said shaft about its axis; means for passing textile fibers through the through-extending passageway of said shaft linearly, generally along the axis of rotation thereof, the fibers being fed into the first end thereof; means for applying a vacuum to the exterior of said shaft so that at least some of the fibers or free ends of fibers passing through said shaft will draw toward the shaft perforations, and will be caused to rotate with said shaft as said fibers move linearly generally along the axis of rotation; means for withdrawing formed yarn from the second end of said shaft, opposite said first end thereof; and a diffuser surrounding said shaft and rotatable therewith.

24. Apparatus for forming yarn comprising: an elongated hollow shaft having a first end and a second end, a through-extending passageway from the first end to the second end, at least a portion of the entire circumference of the shaft being perforated; means for mountind said shaft for rotation about an axis; means for rotating said shaft about its axis; means for passing textile fibers through the through-extending passageway of said shaft linearly, generally along the axis of rotation thereof, the fibers being fed into the first end thereof; means for applying a vacuum to the exterior of said shaft so that at least some of the fibers or free ends of fibers passing through said shaft will draw toward the shaft perforations, and will be caused to rotate with said shaft as said fibers move linearly generally along the axis of rotation; means for withdrawing formed yarn from the second end of said shaft, opposite said first end thereof; and a diffuser surrounding said shaft and rotatable therewith, the diffuser comprising a collar having means defining openings thereon for communicating with said perforations.

25. Apparatus as recited in claim 23 wherein said collar has an elongated slot formed therein corresponding to, and in communication with, each of said perforations; and wherein said collar has an interior surface that is spaced from the exterior surface of said shaft at the area thereof adjacent said perforations and said slots.

26. Apparatus as recited in claim 25 wherein said perforations consist of four perforations formed in said shaft adjacent said first end thereof, and disposed in substantially a common plane perpendicular to the axis of rotation of said shaft.

27. Apparatus as recited in claim 25 wherein said through-extending passageway of said shaft from said first end thereof to approximately the area of said perforations has a diameter X, and wherein said through-extending passageway from approximately the area of said perforations to the second end of said shaft has a diameter x; and wherein X is significantly greater than x.

28. Apparatus as recited in claim 25 wherein said means for mounting said shaft for rotation comprises bearing means mounted to said shaft at two spaced portions thereof at opposite ends of said collar.

29. A textile apparatus comprising:

an elongated hollow shaft having a first end and a second end opposite the first end, and an interior through-extending passageway from the first end to the second end;

means defining a plurality of perforations around the circumferential portion of the shaft adjacent said first end thereof, said perforations communicating between said interior through-extending passageway and the exterior surface of said shaft;

said perforations slanting in the direction of said second end from said through-extending passageway; and a diffuser surrounding said shaft and rotatable therewith, said shaft rotatable about an axis coincident with the direction of elongation of said shaft, and coincident with said through-extending passageway.

30. Apparatus as recited in claim 29 wherein said diffuser comprises a collar having an elongated slot formed therein corresponding to, and in communication with, each of said perforations; and wherein said collar has an interior surface that is spaced from the exterior surface of said shaft at the area thereof adjacent said perforations and said slots.

31. Apparatus as recited in claim 29 wherein said perforations consist of four perforations formed in said shaft adjacent said first end thereof, and disposed in substantially a common plane perpendicular to the axis of rotation of said shaft.

32. Apparatus as recited in claim 29 further comprising means defining a vacuum reservoir in said shaft adjacent said first end thereof, and from which said perforations extend.

33. Apparatus as recited in claim 29 wherein the diameter of said through-extending passageway of said hollow shaft adjacent said first end thereof to approximately the area of said perforations has a diameter X; and wherein said through-extending passageway from approximately the area of said perforations to the second end of said shaft has a diameter x; and wherein X is significantly greater than x.

34. Apparatus as defined in claim 2, wherein said vacuum reservoir is at least partially spherical.

35. Apparatus as defined in claim 2, wherein said vacuum reservoir has at least one tapered portion extending inwardly from said first end toward said second end.

36. Apparatus as defined in claim 35, wherein said perforations extend outwardly from said tapered portion.

37. Apparatus as defined in claim 2, wherein said vacuum reservoir has multiple diameters in planes transverse to said axis.

38. Apparatus as defined in claim 2, wherein each of said perforations is provided with diverging wall portions.

* * * * *